US009346660B2

(12) United States Patent
Orita

(10) Patent No.: US 9,346,660 B2
(45) Date of Patent: May 24, 2016

(54) WATER DISPENSER

(71) Applicant: Kabushiki Kaisha Cosmo Life, Hyogo (JP)

(72) Inventor: Yoshinori Orita, Hyogo (JP)

(73) Assignee: KABUSHIKI KAISHA COSMO LIFE, Hyogo (JP)

( * ) Notice: Subject to any disclaimer, the term of this patent is extended or adjusted under 35 U.S.C. 154(b) by 0 days.

(21) Appl. No.: 14/442,761

(22) PCT Filed: Apr. 19, 2013

(86) PCT No.: PCT/JP2013/061610
§ 371 (c)(1),
(2) Date: May 14, 2015

(87) PCT Pub. No.: WO2014/076982
PCT Pub. Date: May 22, 2014

(65) Prior Publication Data

US 2015/0298957 A1 Oct. 22, 2015

(30) Foreign Application Priority Data

Nov. 15, 2012 (JP) ..... 2012-251007

(51) Int. Cl.
*B67D 1/00* (2006.01)
*B67D 3/00* (2006.01)
(Continued)

(52) U.S. Cl.
CPC ..... *B67D 3/0032* (2013.01); *B67D 1/0009* (2013.01); *B67D 1/0801* (2013.01);
(Continued)

(58) Field of Classification Search
CPC .. B67D 3/0032; B67D 1/0009; B67D 1/0891; B67D 3/0061; B67D 3/0009; B67D 2210/00097; B67D 2001/0091; B67D 2001/0095; B67D 2210/00118
USPC ..... 222/146.6, 80, 81, 83, 83.5, 146.1, 173, 222/95, 105; 137/68.29, 68.3
See application file for complete search history.

(56) References Cited

U.S. PATENT DOCUMENTS 6,986,324 B2 * 1/2006 Gabriel ..... A01K 1/031 119/456
7,458,665 B2 * 12/2008 Batista ..... B41J 2/17509 222/83
2012/0055953 A1 3/2012 Shiotani et al.

FOREIGN PATENT DOCUMENTS

JP 2009-196655 9/2009
JP 2010-228807 10/2010
(Continued)

OTHER PUBLICATIONS

International Search Report issued May 21, 2013 in International (PCT) Application No. PCT/JP2013/061610.

*Primary Examiner* — Kevin P Shaver
*Assistant Examiner* — Robert Nichols, II
(74) *Attorney, Agent, or Firm* — Wenderoth, Lind & Ponack, L.L.P.

(57) ABSTRACT

A water dispenser includes a slide table arranged in a lower portion thereof. The slide table includes a cup portion in which a piercing rod of a water supply line is provided, a container supporting portion configured to support from below a shoulder portion of a raw water container which is a transparent and deformable container, and a holder portion configured to guide downwardly s side peripheral portion of the raw water container. Since the surface color of the piercing rod is different from the surface color of the cup portion and the container supporting portion, it is possible to visually confirm how much the raw water container is pierced by the piercing rod.

5 Claims, 5 Drawing Sheets

(51) Int. Cl.
*B67D 1/08* (2006.01)
*B67D 1/10* (2006.01)

(52) U.S. Cl.
CPC ..... *B67D1/0858* (2013.01); *B67D 1/0891* (2013.01); *B67D 1/0895* (2013.01); *B67D 1/10* (2013.01); *B67D 3/0009* (2013.01); *B67D 3/0061* (2013.01); *B67D 2001/0091* (2013.01); *B67D 2001/0095* (2013.01); *B67D 2001/0815* (2013.01); *B67D 2210/00031* (2013.01); *B67D 2210/00097* (2013.01); *B67D 2210/00118* (2013.01)

(56) References Cited

FOREIGN PATENT DOCUMENTS

| | | |
|---|---|---|
| JP | 2010-285203 | 12/2010 |
| JP | 2011-111228 | 6/2011 |
| JP | 4802299 | 10/2011 |
| JP | 2011-235905 | 11/2011 |
| JP | 2012-171679 | 9/2012 |

* cited by examiner

WATER DISPENSER

TECHNICAL FIELD

The present invention relates to a water dispenser in which water transferred to a temporary water storage tank unit from a replaceable raw water container in advance can be discharged as drinking water.

BACKGROUND ART

Water dispensers allow discharging of water controlled to a certain temperature in a temporary water storage tank(s) through a water discharge line(s), when the user operates a lever or a cock of a water dispenser to open a valve, so that the discharged water can be poured into a cup or the like of the user. In general, the raw water container includes a container body having a neck portion and a shoulder portion, and a plug sealing the neck portion, and is placed at a position higher or lower than that of a temporary water storage tank(s).

An exemplary water dispenser of the type in which the raw water container is placed at a position higher than that of the temporary water storage tank(s) includes: a container supporting portion configured to support the shoulder portion of the raw water container from below; a cup portion recessed from the container supporting portion at a position capable of receiving the neck portion to be inserted from above; a piercing rod configured to pierce the plug from below upward; and a casing containing therein the container supporting portion, the cup portion and the piercing rod. The piercing rod disposed facing upward in the cup portion is configured to pierce the plug of the raw water container which is placed on the container supporting portion from above with its container mouth facing downward, and to be is brought into close contact with the inner periphery of the plug through which it pierces, in a water tight manner. The piercing rod is provided with a water inlet configured to open inside the raw water container and to allow communication between the raw water container and the water supply line which extends from the raw water container to the temporary water storage tank. Arrangement of the raw water container in a vertically reversed position as described above eliminates the need to insert the piercing rod deep inside the raw water container. If the water remaining in the container body leaks when the raw water container is pulled up to be disconnected from the piercing rod, the cup portion receives the leaking water.

Among these, a water dispenser is known in which a deformable container is used as the container body, and which is provided with a holder configured to cover the raw water container placed on the container supporting portion. This container body is a deformable container including a side peripheral portion which is capable of naturally shrinking as the amount of water remaining in the container body decreases and which comes to a position higher than that of the shoulder portion when the container is placed. Therefore, the volume of the container body can be reduced when the raw water container after use is disposed of. If the side peripheral portion capable of naturally shrinking deforms unevenly, significantly biased to one way in the horizontal direction, the neck portion might tilt in the biased direction, and the fitting between the inner periphery of the plug and the outer periphery of the piercing rod might be lost. In order to prevent this problem, the holder configured to guide the side peripheral portion downwardly is provided (below-identified Patent Document 1).

On the other hand, in a water dispenser of the type in which the raw water container is placed at a position lower than that of the temporary water storage tank(s), the raw water container after use can be replaced with a new one without lifting up the heavy new raw water container, and the workload of a user for replacing the raw water container can be reduced. Raw water in the raw water container placed at the lower portion of the casing is drawn up into the temporary water storage tank(s) by a pump disposed in the water supply line. When the water level in one of the temporary water storage tank(s) falls to a predetermined lower limit, the pump is activated automatically, and supplies water to the temporary water storage tank. At this time, if a sensor monitoring the status of the water being pumped detects that there is no more water available to be drawn up, a control section activates a notification device so as to notify the user that the raw water container now needs to be replaced (below-identified Patent Document 2).

In the water dispenser disclosed in the Patent Document 2, when a slide table stored inside of a drawer space provided at the lower portion of the casing is pulled forward, the container supporting portion is exposed to the exterior of the casing, and after the raw water container in a vertically reversed position has been placed on the container supporting portion from above, the slide table can be pushed back into the casing. The piercing rod is provided movably on the slide table such that, when the slide table is pushed back into the drawer space, the piercing rod is automatically elevated to be inserted into the plug of the raw water container which is mounted in a vertically reversed position. If the piercing rod configured to be movable as described above is used, it is not necessary for the user to visually confirm if the piercing rod is securely inserted into the plug of the raw water container. Since the water dispenser disclosed in Patent Document 2 uses a rigid container as the container body, it does not include the holder as in the water dispenser disclosed in Patent Document 1.

PRIOR ART REFERENCES

Patent Documents

Patent Document 1: JP 2010-228807 A
Patent Document 2: JP 4802299 B

SUMMARY OF THE INVENTION

Problems to be Solved by the Invention

However, even in the water dispenser of the type in which the raw water container is provided at the lower portion of the casing, as one disclosed in Patent Document 2, it is more convenient to use a collapsible container as the container body. Since the piercing rod in the water dispenser disclosed in Patent Document 2 is configured to be movable, the structure of the slide table becomes complicated because of the mechanism to allow the piercing rod to be elevated and lowered. If a fixed type piercing rod is used, the mechanism to allow the piercing rod to be elevated and lowered is not required. However, there is a problem that it is difficult to visually confirm how far the piercing rod is inserted into and projected into the raw water container when the container is mounted in a vertically reversed position.

Accordingly, an object of the present invention is to provide a water dispenser which includes the slide table and in which the raw water container is placed at the lower portion of the casing, wherein the water dispenser includes the fixed type piercing rod and the collapsible container as the container body, and wherein the degree of penetration of the piercing rod into the raw water container can be visually confirmed with ease, when the raw water container is mounted on the slide table.

Means for Solving the Problems

In order to achieve the above object, the present invention presupposes:

a water dispenser comprising a casing, wherein the casing includes a temporary water storage tank unit;

a slide table configured to be pulled forward from a drawer space arranged at a lower level than the temporary water storage tank unit;

a raw water container configured to be placed on the slide table; and a water supply line through which raw water in the raw water container is supplied to the temporary water storage tank unit, wherein the raw water container includes a container body having a neck portion and a shoulder portion; and a plug sealing a container mouth provided at the neck portion, wherein the slide table includes a container supporting portion configured to support the shoulder portion from below; and a piercing rod configured to pierce the plug upwardly; and wherein the piercing rod is formed with a water inlet through which raw water in the container body is supplied into the water supply line.

The container body according to the present invention is a transparent and deformable container including a side peripheral portion which is arranged at a higher level than the shoulder portion, and which is configured to naturally shrink as the amount of water remaining in the container body decreases. As the amount of water remaining in the container body decreases due to the drawing-up of water, the pressure inside of the container body is reduced to a negative pressure relative to the atmospheric pressure. The difference between the pressures acts on the side peripheral portion, so that the side peripheral portion can naturally shrink. If raw water is drawn up from the deformable container having the side peripheral portion which is arranged at a higher level than the shoulder portion, and which is configured to naturally shrink, the volume of the raw water container which has been used up is reduced and thus the container can be disposed of easily. Further, since the container body is a deformable container, the container body can be a transparent container made of a synthetic resin having a low crystallinity. When the user lifts up the raw water container in a vertically reversed position so as to place the container on the slide table, the user is able to see the position of the slide table through the transparent container body, and to determine the position in the air appropriate for lowering the raw water container. The transparency of the container body can be determined as appropriate to such an extent that the user can see the position of the slide table through the transparent container body from the outside of the container body, although the higher the better.

Further, the slide table according to the present invention includes a cup portion recessed from the container supporting portion such that the neck portion can be inserted into the cup portion from above; and a holder portion integrally connected to a circumference of the container supporting portion and configured to guide the side peripheral portion downwardly. The piercing rod is disposed inside of the cup portion so as to pierce the plug upwardly when the raw water container is lowered from above so as to be placed on the container supporting portion.

Since the neck portion can be inserted from above into the cup portion recessed from the container supporting portion onto which the shoulder portion of the container body is placed, the cup portion is capable of receiving the water leaking from the plug, thereby preventing water from leaking on the floor on which the casing is placed or leaking on the bottom surface of the drawer space. If the piercing rod is disposed inside of the cup portion, the piercing rod can pierce the plug upwardly by utilizing the lowering movement of the raw water container placed on the container supporting portion from above. In this way, the slide table can be provided with the piercing rod which is a fixed type. By integrally connecting the holder portion to the circumference of the container supporting portion, the side peripheral portion of the container body can be guided downwardly. It is sufficient that this guidance is performed such that the side peripheral portion does not get caught on the holder portion due to its uneven deformation biased to one way in the horizontal direction, and such that the fitting between the inner periphery of the plug and the outer periphery of the piercing rod is not lost. Therefore, it is not necessary to perform this guidance at the first stage of the natural shrinking, namely, at the beginning of the drawing-up of water from a new raw water container.

The surface color of the piercing rod according to the present invention is different from the surface color of the cup portion and of the container supporting portion.

In order to achieve the above guidance of the side peripheral portion, the height of the holder portion needs to be not less than the half of the height of the container body placed on the container supporting portion. When a heavy and new raw water container passes through the upper portion of the holder portion, there is the possibility that the user may bump the raw water container against the holder portion by mistake. Further, the container supporting portion receives the weight of the raw water container. Still further, when the piercing rod pierces the plug, the cup portion supports the piercing rod against the weight of the raw water container. Therefore, these portions such as the holder portion are required to be made of a material such as a synthetic resin or a metal having a high mechanical strength and a high crystallinity, and thus are opaque.

Since the holder portion is formed to have a height higher than that of the container supporting portion as described above, by the time when the piercing rod pierces the plug, the neck portion and the shoulder portion of the container body are already inserted deeply inside of the holder portion. Since the container body is transparent, the user is able to see the vicinity of the neck portion through the vicinity of the bottom portion of the container body which is not covered by the opaque holder portion, and thus to visually confirm how much the container body is pierced by the piercing rod. At this time, since the user sees the vicinity of the neck portion from above the container body or from obliquely above the container body, it is possible that the cup portion or the container supporting portion comes to a position below or behind the piercing rod seen from the viewpoint of the user, being its background. If the surface color of the piercing rod is the same as the surface color of a portion being the background of the piercing rod, it is difficult to judge how much the container body is pierced by the piercing rod. If the piercing rod is formed to have a surface color different from the surface color of the cup portion and the container supporting portion which can be the background color of the piercing rod, the difference between the colors facilitates the visual confirmation of the degree of piercing.

For example, the cup portion and the container supporting portion are components which are made of a resin and of which the surface color is a white molding color. As used herein, "white molding color" refers to an opaque white color of a molding made of a synthetic resin which color is produced due to high crystallinity of the synthetic resin, or to a color whose whiteness is further enhanced from the opaque white color of the molding, using a coloring agent.

If the white molding color is adopted as the surface color of the cup portion and the container supporting portion, it is possible to produce the cup portion and the container supporting portion by molding of a resin having a high mechanical strength. Since the light reaching the container supporting portion or the cup portion through the container body is reflected by the white molded surface thereof, it is possible to prevent a reduction in the illuminance in the vicinity of the neck portion, which needs to be confirmed visually.

In addition, the surface color of the piercing rod is preferably a chromatic color which is different in lightness from the surface color of the cup portion and of the container supporting portion. In general, the most effective way to improve the visibility is to utilize the difference in lightness, among various color differences, with the difference in saturation being the second. Since the surface color of the cup portion and the container supporting portion is the white molding color, if the surface color of the piercing rod is colored to a chromatic color having a different lightness, the difference in lightness and saturation serves to improve the visibility of the piercing rod when visually confirming the degree of piercing.

If the holder portion is also included in the components made of a resin, the reflection from the holder portion whose surface color is the white molding color also serves to prevent reduction in the illuminance in the vicinity of the neck portion.

If the surface color of the piercing rod is a red-based or yellowish red-based color, an excellent visibility of the piercing rod can be obtained even when the portion being its background is in the white molding color. As used herein, "a red-based or yellowish red-based color" refers to those defined in "Names of non-luminous object colours" (JIS Z8102:2001) of the Japanese Industrial Standards.

Effect of the Invention

As described above, the present invention provides a water dispenser comprising a casing, wherein the casing includes a temporary water storage tank unit;

a slide table configured to be pulled forward from a drawer space arranged at a lower level than the temporary water storage tank unit;

a raw water container configured to be placed on the slide table; and a water supply line through which raw water in the raw water container is supplied to the temporary water storage tank unit, wherein the raw water container includes a container body having a neck portion and a shoulder portion; and a plug sealing the neck portion, wherein the slide table includes a container supporting portion configured to support the shoulder portion from below; and a piercing rod configured to pierce the plug upwardly; and wherein the piercing rod is formed with a water inlet through which raw water in the container body is supplied into the water supply line;

characterized in that the container body is a transparent and deformable container including a side peripheral portion which is arranged at a higher level than the shoulder portion, and which is configured to naturally shrink due to the effect of the atmospheric pressure as an amount of water remaining in the container body decreases, wherein the slide table includes the container supporting portion, a cup portion recessed from the container supporting portion such that the neck portion can be inserted into the cup portion from above; and a holder portion integrally connected to a circumference of the container supporting portion and having a height sufficient to receive therein the container body which has been used up, wherein the piercing rod is disposed inside of the cup portion so as to pierce the plug upwardly when the raw water container is lowered from above so as to be placed on the container supporting portion, and wherein a surface color of the piercing rod is different from a surface color of the cup portion and of the container supporting portion.

The water dispenser of the present invention includes a fixed piercing rod and a deformable container as the container body of the raw water container, and allows for visually confirming with ease how much the container body is pierced by the piercing rod, when the raw water container is placed on the slide table.

MODE FOR CARRYING OUT THE INVENTION

Figure 1:
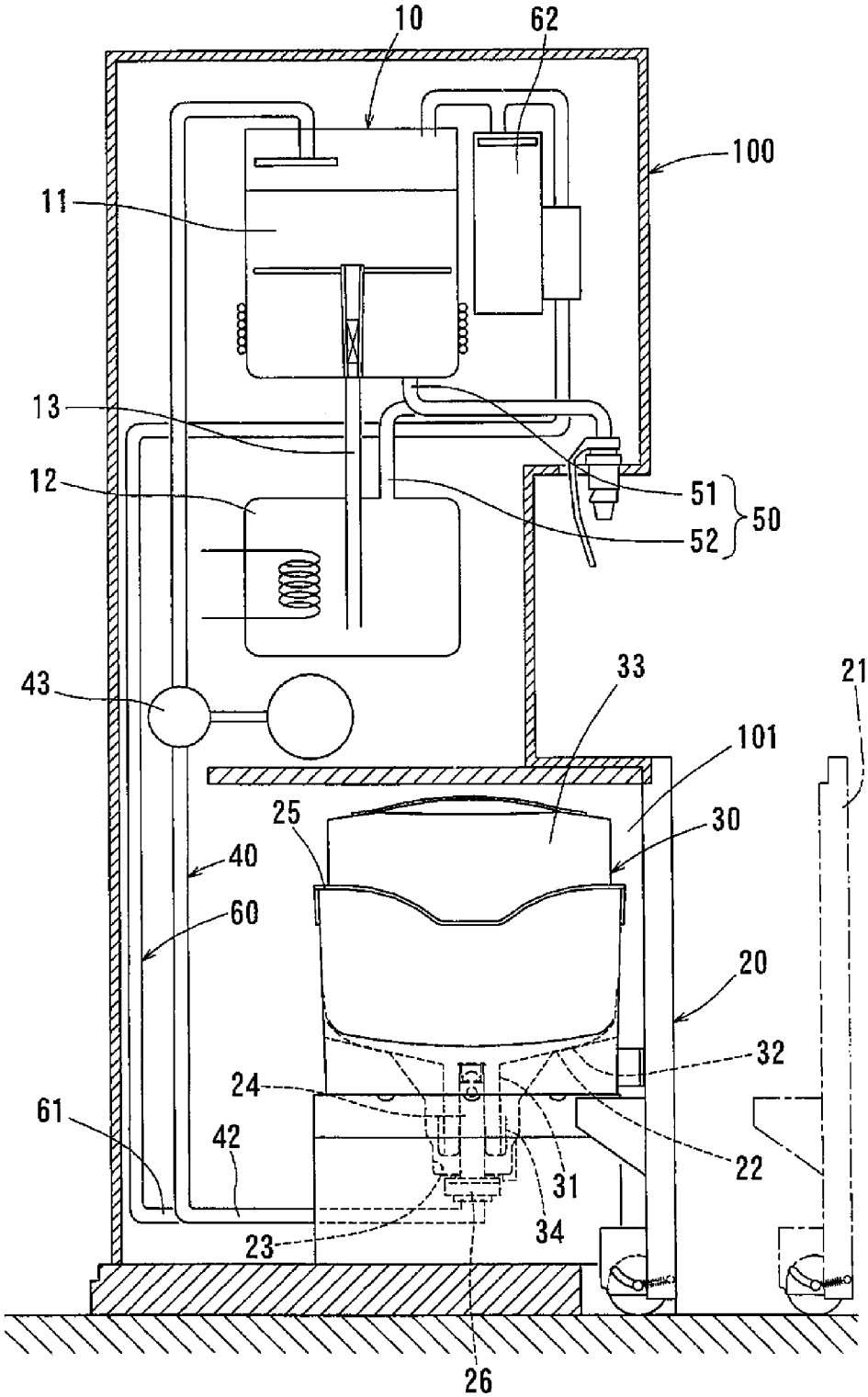
FIG. 1 is a schematic view illustrating the overall structure of a water dispenser embodying the present invention.

An example of the water dispenser embodying the present invention (hereinafter, simply referred to as "this water dispenser") will now be described with reference to the accompanying drawings. As illustrated in FIG. 1, this water dispenser includes a casing 100, the casing 100 having a temporary water storage tank unit 10, a slide table 20 configured to be pulled forward from a drawer space 101 arranged at a lower level than the temporary water storage tank unit 10, a raw water container 30 configured to be placed on the slide table 20, a water supply line 40 through which raw water is supplied from the raw water container 30 to the temporary water storage tank unit 10, water discharge lines 50 through which water is discharged from the temporary water storage tank unit 10 to the exterior of the water dispenser, and an air intake line 60 which communicates with the raw water container 30 and atmospheric air.

Figure 2:
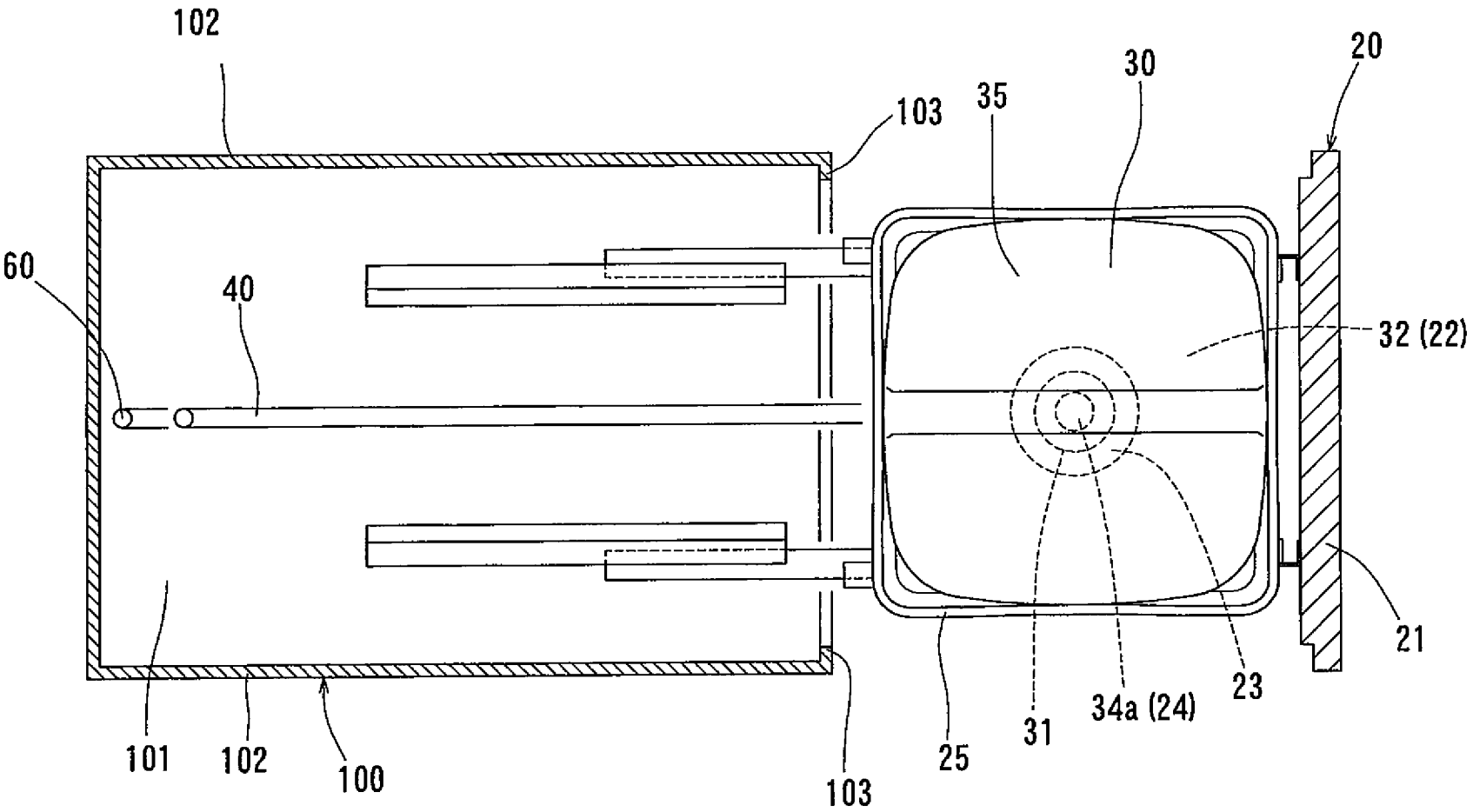
FIG. 2 is a top view of the water dispenser embodying the present invention, illustrating the state in which a slide table has been pulled out of a casing in order to carry out the mounting of a raw water container thereon.

As illustrated in FIGS. 1 and 2, the casing 100 is a vertically elongated casing including right and left side plates 102 defining the drawer space 101, a top plate, a bottom plate and a front plate through which the two side plates 102 are connected together on the right and left sides of the casing, and an intermediate plate, etc. The drawer space 101, arranged in the lower portion of the casing 100, is covered by a front panel 21 of the slide table 20. The side plates 102 include front distal end portions 103 which are bent so as to be opposed to each other from the right and left sides of the casing. The front distal end portions 103 are opposed to the front panel 21 of the slide table 20 in the forward and rearward directions.

In the temporary water storage tank unit 10 illustrated in FIG. 1, the temperature of water is adjusted. Specifically, the temporary water storage tank unit 10 includes a cold water tank 11 in which water is cooled by a heat exchanger, a hot water tank 12 in which water is heated by a heater, and a water transfer line 13. The inlet of the water transfer line 13 is provided at a baffle plate which prevents the descent of raw water flowing into the cold water tank 11 from the water supply line 40. Water remaining in the upper portion of the cold water tank 11 flow into the hot water tank 12 through the water transfer line 13. The temporary water storage tank unit 10 may include only one of the cold water tank 11 and the hot water tank 12.

The water discharge lines 50 are lines through which water contained in the temporary water storage tank unit 10 is discharged. The water discharge lines 50 are constituted by a cold water discharge line 51 connected to the cold water tank 11, and a hot water discharge line 52 provided independently of the cold water discharge line 51 and connected to the hot water tank 12. When the user opens a valve which serves as a boundary between the cold water discharge line 51 and the temporary water storage tank unit 10 or between the hot water discharge line 52 and the temporary water storage tank unit 10, water remaining in the lower portion of the cold water tank 11 or water remaining in the upper portion of the hot water tank 12 is discharged through the cold water discharge line 51 or the hot water discharge line 52, so that the discharged water can be poured into a cup, etc.

Figure 3:
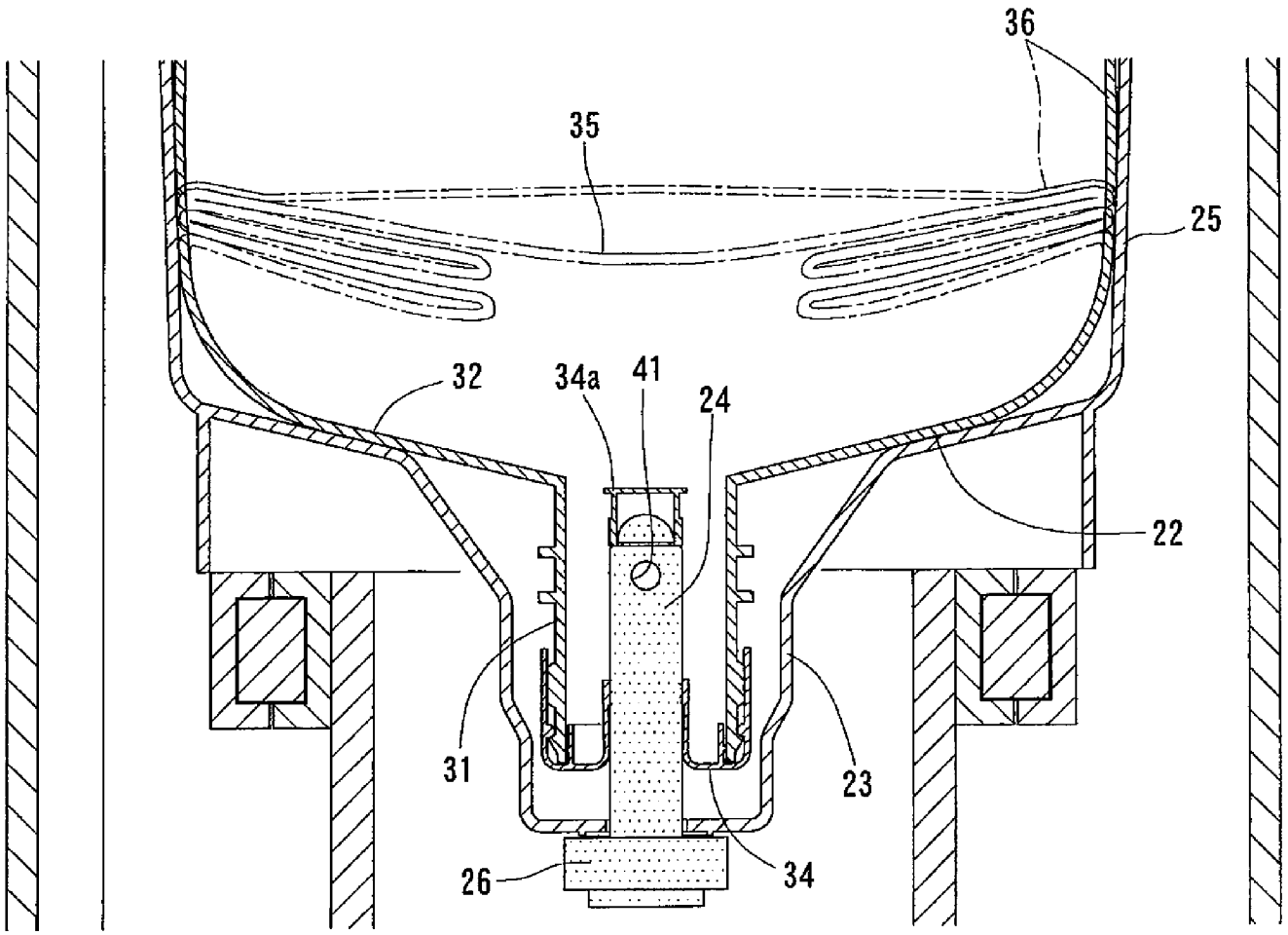
FIG. 3 is a partial sectional view of the water dispenser embodying the present invention, illustrating the structure in the vicinity of a piercing rod.
Figure 4:
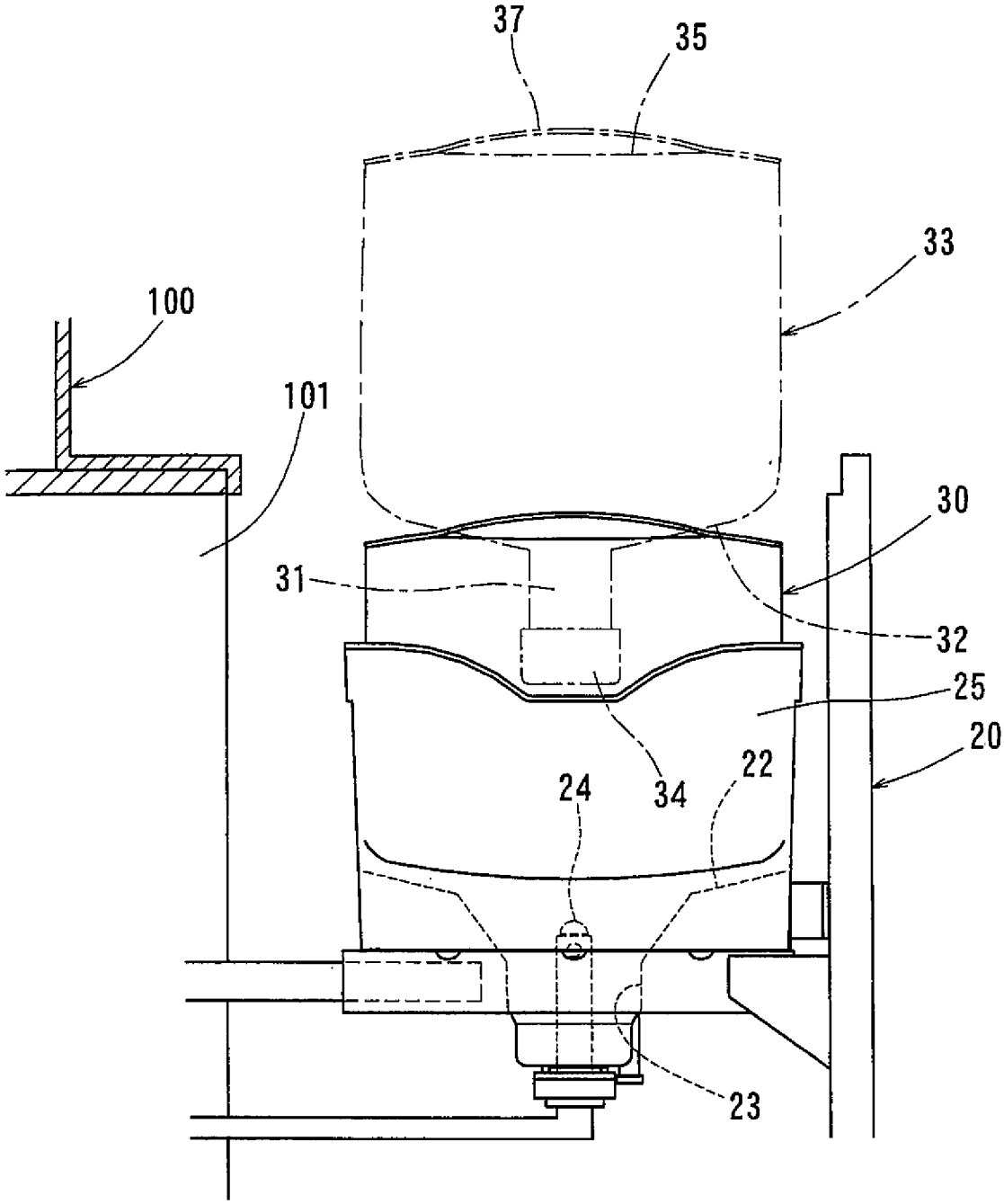
FIG. 4 is a side view of the water dispenser embodying the present invention, illustrating the state in which the slide table has been pulled out of the casing in order to carry out the mounting of the raw water container thereon.

As illustrated in FIGS. 3 and 4, the raw water container 30 includes a container body 33 having a neck portion 31 and a shoulder portion 32, and a plug 34 sealing the neck portion 31. The container body 33 is also provided with a bottom portion 35, so that the container body 33 can be placed on a horizontal surface with a container mouth provided at the neck portion 31 facing upwardly at the highest position of the container body 33. Raw water is introduced into the container body 33 through the container mouth provided at the neck portion 31, and the container body 33 can be kept filled with a predetermined amount of water by attaching the plug 34 to the neck portion 31. The shoulder portion 32 is configured to be supported by the slide table 20 from below with the raw water container 30 being placed in the vertically reversed position (with the bottom portion 35 coming to the highest position), until water in the container body 33 is used up to a predetermined level. The shoulder portion 32 is formed with a slope so that raw water in the container gathers to the container mouth of the neck portion 31. In order to reduce the amount of water remaining in the neck portion 31 and to allow the plug 34 to be press-fitted into the neck portion in the vertical direction, the neck portion 31 is formed to be a tubular-shaped and protruding portion having a vertically extending axis and an outer diameter narrower than the diameter of the shoulder portion 32.

Figure 5:
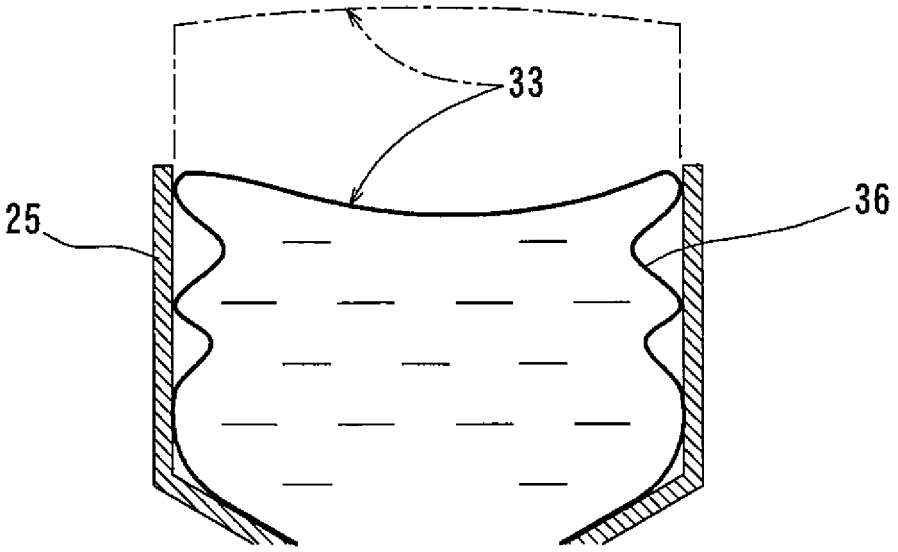
FIG. 5 is a view of the water dispenser embodying the present invention, illustrating the process in which a side peripheral portion of a container body is guided by a holder portion when the container collapses.

The container body 33 is a transparent and deformable container portion including a side peripheral portion 36 which is arranged at a higher level than the shoulder portion 32, and which is configured to naturally shrink as the amount of water remaining in the container body 33 decreases. In order to maintain the shape of the shoulder portion 32 along a container supporting portion 22 and to stabilize the posture of the raw water container 30 until raw water in the container is used up, it is preferable that the rigidity of the shoulder portion 32 is increased by forming ribs on the shoulder portion 32, or by increasing the thickness of the shoulder portion 32. Also, in order to prevent the side peripheral portion 36 from unevenly deforming by shrinking so as to be biased to one way in the horizontal direction, it is preferable that the side peripheral portion 36, provided between the shoulder portion 32 and the bottom portion 35, is formed with fold lines which make it easier for the side peripheral portion 36 to deform and shrink evenly in the circumferential direction. For example, as illustrated in FIGS. 3 and 5, in order to make it easier for the container to naturally shrink such that the side peripheral portion 36 is folded like bellows, the fold lines extending in the circumferential direction can be formed on the side peripheral portion 36 at regular intervals in the vertical direction. The container body 33 as described above can be produced by blow molding of, for example, polyamide (PA) or polyethylene (PET). As illustrated in FIG. 4, a grip 37 is attached on the bottom portion 35 of the container body 33 so that the raw water container 30 in the vertically reversed position can be easily lifted up.

As illustrated in FIGS. 1, 2, and 4, the slide table 20 is slidable linearly in a horizontal direction relative to the casing 100 along guide rails provided on the bottom plate of the casing 100. The directions in which the slide table 20 is slid correspond to the forward and rearward directions of the water dispenser. As illustrated in FIGS. 2 and 3, the slide table 20 includes the container supporting portion 22 configured to support the shoulder portion 32 of the container body 33 from below, a cup portion 23 recessed from the container supporting portion 22, a piercing rod 24 configured to pierce the plug 34 upwardly, and a holder portion 25 integrally connected to the circumference of the container supporting portion 22.

The container supporting portion 22 is a wall surface portion capable of coming into contact with the shoulder portion 32 in the vertical direction, and of supporting the weight of the raw water container 30 from below. The cup portion 23 is a wall surface portion recessed downwardly from the container supporting portion 22, and having a depth and a horizontal position range enabling the neck portion 31 to be inserted from above. The piercing rod 24 is a rod-like member including a distal end portion configured to protrude into the container body 33 of the raw water container 30 when the container 30 is placed on the container supporting portion 22, and an outer peripheral seal surface configured to come into close contact with the inner periphery of the plug 34 of the container 30. As illustrated in FIG. 2, the piercing rod 24 is provided inside of the cup portion 23 so as to face upwardly and to be made the geometric center of the container supporting portion 22 and the holder portion 25, which are both formed annularly in plan view. As illustrated in FIGS. 3 and 5, the holder portion 25 is a wall surface portion capable of guiding downwardly the side peripheral portion 36 which naturally shrinks. When the slide table 20 is pulled forward, as illustrated in FIGS. 2, 4, the entire upper region of the holder portion 25 is moved out of the casing 100. Therefore, the neck portion 31 of the raw water container 30 in a vertically reversed position can be inserted into the cup portion 23 from above, and the shoulder portion 32 of the container 30 can be placed on the container supporting portion 22 from above. The cup portion 23 is capable of receiving the water leaking from between the plug 34 and the piercing rod 24.

The interior of the piercing rod 24 is divided into a portion forming one end of the water supply line 40 and a portion forming one end of the air intake line 60. As illustrated in FIG. 3, the piercing rod 24 is formed with a water inlet 41. The water inlet 41 is an opening through which raw water in the container body 33 is supplied into the water supply line 40 illustrated in FIG. 1. The piercing rod 24 is also formed with a vent hole (not shown) through which air taken into the air intake line 60 is released into the container body 33.

The clearance between the holder portion 25 and the side peripheral portion 36, the height of the holder portion 25 relative to the raw water container 30 placed on the container supporting portion 22, and the height of the piercing rod 24 relative to the cup portion 23 and the container supporting portion 22 are predetermined such that when the raw water container 30 lifted up in a vertically reversed position is lowered within the holder portion 25, as illustrated by the alternate long and two short dashed line in FIG. 4, the container body 33 is guided by the holder portion 25 so that the central portion of the plug 34 abuts the piercing rod 24 before the container supporting portion 22 comes into contact with the shoulder portion 32, the piercing rod 24 pierces the plug 34 upwardly, the water inlet 41 and the vent hole communicate with the interior of the container body 33, as illustrated in FIG. 3, then the shoulder portion 32 is placed on the container supporting portion 22, and the outer peripheral seal surface of the piercing rod 24 comes into close contact with the inner periphery of the portion of the plug 34 pierced by the piercing rod 24 and remaining on the side of the neck portion 31. The central portion 34*a* of the plug 34 is configured to be removed from the plug 34, to be fitted to the distal end portion of the piercing rod 24, and to remain fitted to the distal end portion of the rod 24, even after the piercing has been completed, by being caught on a groove in the piercing rod 24. When the raw water container 30 is lifted up so as to be pulled out of the piercing rod 24, the central portion 34*a* is configured to be removed from the distal end portion of the piercing rod 24 and to be fitted to the inner periphery of the portion of the plug 34 pierced by the piercing rod 24 and remaining on the side of the neck portion 31.

The piercing rod 24 is inserted through a through hole formed in the cup portion 23 so as to be fitted on the inner periphery of the though hole, and is fixed to the cup portion 23 by a relay member 26 attached to the outside of the cup portion 23. As illustrated in FIG. 1, the water supply line 40 and the air intake line 60 have a connection pipe 42 and a connection pipe 61, respectively, and one end of each of the connection pipes 42 and 61 is connected to the relay member 26. Each of the connection pipes 42 and 61 is, for example, a flexible pipe which is extendable and thus capable of following the movement of the slide table 20 when the slide table 20 is pulled out of or into the casing. A pump 43 is attached to a portion of the water supply line 40. The pump 43 may be, for example, a plunger pump or a gear pump. The air intake line 60 takes in air from an air chamber 62 which communicates with atmospheric air, and allows communication between the interior of the container body 33 and atmosphere at all times. Therefore, the air chamber 62 is preferably provided with a filter for filtering contaminants such as dust and bacteria in air, and for deodorizing air.

After the slide table 20 with the raw water container 30 placed thereon has been pushed rearward and stored into the casing 100, when the pump 43 is turned on, the pump 43 starts to draw up water through the water supply line 40 for the first time. While water is being drawn up, as the water level in the temporary water storage tank unit 10 rises, the air inside of the temporary water storage tank unit 10 is discharged through the air chamber 62, which communicates with the tank unit 10. As illustrated in FIG. 5, the side peripheral portion 36 naturally shrinks by degrees as the amount of water remaining in the container body 33 decreases, so that the height of the container body 33 lowers gradually. When the water level in the temporary water storage tank unit 10 illustrated in FIG. 1 reaches a predetermined upper limit, the pump 43 automatically stops drawing up water. When the water in the temporary water storage tank unit 10 is repeatedly discharged through the water discharge lines 50 thereafter, and a water level sensor detects that the water level in the temporary water storage tank unit 10 has fallen to a predetermined lower limit, the pump 43 automatically starts to draw up water again. As long as the side peripheral portion 36 naturally shrinks as illustrated in FIG. 5, water in the container is not forcibly drawn up by the pump. However, as water is repeatedly drawn up, the side peripheral portion 36 becomes folded in multiple layers as illustrated by the alternate long and two short dashed line in FIG. 3, so that the side peripheral portion 36 cannot naturally shrink any further.

The side peripheral portion 36 is guided by the holder portion 25 downwardly from a sufficiently high position as illustrated in FIG. 5. Therefore, even if the side peripheral portion 36 unevenly shrinks while being biased to either the right or left, or forward or rearward, there is no potential risk that the shrunk portion of the side peripheral portion 36 extends over the holder portion 25. In addition, since the distal end edge or the wall surface of the holder portion 25 is rounded and smooth so as not to bite into the side peripheral portion 36, there is also no potential risk that the side peripheral portion 36 gets caught on the edge or the wall surface when the side peripheral portion 36 is guided by the holder portion 25. Even if the shrunk portion of the side peripheral portion 36 extends slightly over the holder portion 25 when the side peripheral portion 36 naturally shrinks, the side peripheral portion 36 is eventually guided inside of the holder portion 25 as the natural shrinking proceeds. Thus, due to the guidance by the holder portion 25, the side peripheral portion 36 shrinks without being largely inclined to one way in the vertical direction. As a result thereof, until the side peripheral portion 36 shrinks to the limit as illustrated in FIG. 3, the fitting between the inner periphery of the portion of the plug 34 pierced by the piercing rod 24 and the outer peripheral seal surface of the piercing rod 24 can be secured.

After the side peripheral portion 36 has become unable to naturally shrink any further, as the amount of water remaining in the container body 33 further decreases, the balancing effect kicks in, namely air starts to flow into the container body 33 through the air intake line 60 illustrated in FIG. 1, thereby overcoming the negative pressure inside of the container body 33. As a result thereof, it is possible to use up raw water in the raw water container 30 to a predetermined level without forcibly drawing up water in the container by the pump 43. As used herein, the situation in which raw water in the raw water container 30 has been used up to a predetermined level corresponds to the situation in which the level of water remaining in the container body 33 has fallen below the position of the water inlet 41 illustrated in FIG. 3. This water dispenser is provided with a sensor monitoring the amount of water flowing in the water supply line, and when the sensor detects that there is no water flowing in the water supply line, a notification device is activated, for example, a lamp is turned on, so as to notify the user that the raw water container now needs to be replaced.

It is preferable that the height of the holder portion 25 relative to a new raw water container 30 placed on the container supporting portion 22 is not less than ½ of the height of the container body 33 and not more than the height of the container body 33. If the height of the holder portion 25 is not less than ½ of the height of the container body 33, the side peripheral portion 36 can be reliably guided, and in addition, the raw water container 30 can be reliably received within the holder portion 25, as illustrated in FIG. 3, when raw water in the raw water container 30 has been used up to a predetermined level. Since the used up raw water container 30 is received within the holder portion 25, it is possible to avoid the potential risk that when the slide table 20 is pulled out of the casing for replacement of the container, the side peripheral portion 36 which has shrunk and become rigid might get caught on one of the right and left front distal end portions 103 illustrated in FIG. 2, and that the slide table 20 might not be able to be smoothly pulled out of the casing as a result thereof. If the height of the holder portion 25 exceeds the height of the container body 33, the raw water container 30 has to be lifted up more than necessary, when the container is replaced.

The container supporting portion 22, the cup portion 23 and the holder portion 25 illustrated in FIGS. 2 and 3 are components which are made of a resin and of which the surface color is a white molding color. The components made of a resin are integrally formed into the shape of a bucket by injection molding of a synthetic resin. The white molding color of the components is obtained by using a synthetic resin which becomes opaque and clouded, such as polyamide (PA), high density polyethylene (PE), polystyrene (PS), polyacetal (POM), polybutylene terephthalate (PBT), and by coloring the resin white using a coloring agent such as titanic acid as necessary.

On the other hand, the surface color of the piercing rod 24 is a red-based or yellowish red-based color whose lightness is different from that of the white molding color which is the surface color of the above components made of a resin. The surface color of the piercing rod 24 is obtained by molding of a synthetic resin containing a coloring agent(s).

The piercing rod 24 is repeatedly exposed to abrasion by the plug 34, and the components made of a resin are also repeatedly exposed to abrasion by the container body 33. However, since these components are formed to have their molding colors as their surface colors, there is no possibility that their surface colors fall off to reveal the original molding colors, as in the case of painted colors.

As illustrated in FIG. 4, the user (not shown) pulls the slide table 20 forward and carries the raw water container 30 above the slide table 20 with the container 30 in a vertically reversed position. At this time, the user is able to see the positions of the holder portion 25 and the cup portion 23 through the transparent container body 33 as illustrated in FIG. 2, and thus, the container body 33 can be easily brought to a position in the air which is inside of and above the holder portion 25.

Further, after the container body 33 has been lowered, the user is able to see the status in the vicinity of the neck portion 31 inserted deeply inside of the opaque holder portion 25 through the vicinity of the bottom portion 35 of the container body 33, and to visually confirm how much the piercing rod 24 has pierced the container body 33. Normally, when the container body 33 is pierced by the piercing rod 24, the central portion 34*a* of the plug 34 is fitted to the distal end portion of the piercing rod 24. Therefore, the user visually confirms the position of the piercing rod 24 from obliquely above. At this time, since the piercing rod 24 and the cup portion 23, etc. have surface colors different from each other, even if the cup portion 23 or the container supporting portion 22 illustrated in FIG. 3 comes to a position below or behind the piercing rod 24 seen from the viewpoint of the user, being its background, the user can easily distinguish the piercing rod 24 from the cup portion 23, etc., and can visually confirm with ease how much the piercing rod 24 has pierced the container body 33. Preferably, the grip 37 is made of a transparent film so as not to prevent the user from seeing the position of the piercing rod 24, etc. therethrough. When an opaque grip is used as the grip 37, the user has to visually confirm the position of the cup portion 23, etc. from obliquely above, avoiding the grip 37.

As described above, this water dispenser includes the fixed piercing rod 24 and the deformable container body 33, and is configured such that when the raw water container 30 is placed on the slide table 20, the user can visually confirm with ease how much the container body 33 is pierced by the piercing road 24. Further, since the holder portion 25, the container supporting portion 22 and the cup portion 23, the surface color of which is a white molding color, tend to reflect the illumination light coming in from above the container body 33 to the vicinity of the neck portion 31, it is possible to prevent reduction in the illuminance in the vicinity of the neck portion 31, which needs to be visually confirmed.

Since the container body 33 is transparent, the portion of the plug 34 pierced by the piercing rod 24 and remaining on the side of the neck portion 31 can also be the background of the piercing rod 24, although not so much as the cup portion 23 or the container supporting portion 22, when the user visually confirms how much the container body 33 is pierced by the piercing rod 24. Therefore, it is preferable that the surface color of the piercing rod 24 is also different from the surface color of the portion of the plug 34 pierced by the piercing rod 24. For example, in cases where the surface color of the piercing rod 24 is a red-based or yellowish red-based color, by forming the portion of the plug 34 pierced by the piercing rod 24 to have a blue-based surface color, it is possible to improve the visibility of the piercing rod 24 when the portion of the plug 34 pierced by the piercing rod 24 becomes the background of the piercing rod 24. As used herein, the "blue-based color" refers to those defined in JIS Z8102: 2001.

The surface color of each of the piercing rod 24 and the cup portion 23, etc. is not limited to that described in this embodiment. The visibility of the piercing rod 24 can be improved by enhancing the contrast in lightness, saturation and hue between the surface color of the piercing rod 24 and the surface color of the portions which can be the background of the piercing rod. For example, it is preferred to use the "highly distinguishable color combinations" defined in "Guidelines for the elderly and people with disabilities—Visual signs and displays—A method for color combinations based on categories of fundamental colors as a function of age" (JIS S0033: 2006) of the Japanese Industrial Standards. In this water dispenser, basically, it is determined that the surface color of the piercing rod 24 be red or yellowish red, the surface color of the cup portion 23 and the like be the white molding color, the surface color of the portion of the plug 34 pierced by the piercing rod 24 be blue. Therefore, it is possible to realize the "highly distinguishable color combinations", irrespective of the conditions defined in the above described standards such as "photopic vision", "mesopic vision", "the elderly", and "juveniles". The technical scope of the present invention is not limited to the above described embodiment, and includes all of the alterations and variations falling within the technical scope of the claims.

DESCRIPTION OF SYMBOLS

10 temporary water storage tank unit
20 slide table
22 container supporting portion
23 cup portion
24 piercing rod
25 holder portion
30 raw water container
31 neck portion

32 shoulder portion
33 container body
34 plug
36 side peripheral portion
40 water supply line
41 water inlet
100 casing
101 drawer space

The invention claimed is:

1. A water dispenser comprising a casing, wherein the casing includes a temporary water storage tank unit;

a slide table configured to be pulled forward from a drawer space arranged at a lower level than the temporary water storage tank unit;

a raw water container configured to be placed on the slide table; and a water supply line through which raw water in the raw water container is supplied to the temporary water storage tank unit, wherein the raw water container includes a container body having a neck portion and a shoulder portion; and a plug sealing the neck portion, wherein the slide table includes a container supporting portion configured to support the shoulder portion from below; and a piercing rod configured to pierce the plug upwardly;

wherein the piercing rod is formed with a water inlet through which raw water in the container body is supplied into the water supply line;

wherein the container body is a transparent and deformable container including a side peripheral portion which is arranged at a higher level than the shoulder portion, and which is configured to naturally shrink as an amount of water remaining in the container body decreases, wherein the slide table includes a cup portion recessed from the container supporting portion such that the neck portion can be inserted into the cup portion from above; and a holder portion integrally connected to a circumference of the container supporting portion and configured to guide the side peripheral portion downwardly, wherein the piercing rod is disposed inside of the cup portion so as to pierce the plug upwardly when the raw water container is lowered from above so as to be placed on the container supporting portion, and wherein a surface color of the piercing rod is different from a surface color of the cup portion and of the container supporting portion.

2. The water dispenser according to claim 1, wherein the cup portion and the container supporting portion are components which are made of a resin and of which the surface color is a white molding color, and wherein the surface color of the piercing rod is a chromatic color which is different in lightness from the surface color of the cup portion and of the container supporting portion.

3. The water dispenser according to claim 2, wherein the holder portion is also included in the components made of a resin.

4. The water dispenser according to claim 2, wherein the surface color of the piercing rod is a red-based or yellowish red-based color.

5. The water dispenser according to claim 3, wherein the surface color of the piercing rod is a red-based or yellowish red-based color.

* * * * *